US008641386B2

(12) United States Patent
Szuster et al.

(10) Patent No.: US 8,641,386 B2
(45) Date of Patent: Feb. 4, 2014

(54) METHOD AND DEVICE FOR PUMPING LIQUIDS USING A PNEUMATIC POSITIVE DISPLACEMENT PUMP

(75) Inventors: Miroslaw Szuster, Biala (PL); Rafal Wojciechowski, Koszalin (PL)

(73) Assignee: Ekowodrol sp. z o.o., Koszalin (PL)

( * ) Notice: Subject to any disclaimer, the term of this patent is extended or adjusted under 35 U.S.C. 154(b) by 305 days.

(21) Appl. No.: 13/130,400

(22) PCT Filed: Nov. 21, 2009

(86) PCT No.: PCT/PL2009/050037

§ 371 (c)(1),
(2), (4) Date: Jun. 24, 2011

(87) PCT Pub. No.: WO2010/059069

PCT Pub. Date: May 27, 2010

(65) Prior Publication Data

US 2011/0255998 A1 Oct. 20, 2011

(30) Foreign Application Priority Data

Nov. 21, 2008 (PL) ..... 386571

(51) Int. Cl.
*F04F 5/46* (2006.01)
*F04F 1/18* (2006.01)
*F04F 1/06* (2006.01)

(52) U.S. Cl.
USPC ..... 417/54; 417/109; 417/123; 417/125

(58) Field of Classification Search
USPC ..... 417/108, 109, 137, 138, 122, 123, 125, 417/54
See application file for complete search history.

(56) References Cited

U.S. PATENT DOCUMENTS 1,594,483 A 8/1926 Yeomans
2,300,039 A * 10/1942 Yeomans et al. ..... 417/120
3,049,489 A 8/1962 Ciabattari
3,118,391 A * 1/1964 Ciabattari ..... 417/138
(Continued)

FOREIGN PATENT DOCUMENTS

WO 9635880 11/1996

OTHER PUBLICATIONS

International Search Report issued by the International Searching Authority (ISA/O.E.P.M.) on Apr. 19, 2010 in connection with International Application No. PCT/PL2009/050037.

*Primary Examiner* — Charles Freay
(74) *Attorney, Agent, or Firm* — Gary J. Gershik; Cooper & Dunham LLP

(57) ABSTRACT

A method of pumping a liquid using at least one operating tank (2), a pneumatic positive pressure displacement pump (1), which is based on the fact that during pumping, inflow valve (4) closure is controlled through the introduction of a control gas into the operating tank (2) positive pressure displacement pump (1) at a pressure lower than the pressure of the compressed actuating gas and from the hydrostatic pressure at the egress of the outflow valve but higher than the hydrostatic pressure on the ingress into the inflow valve (4), which causes the inflow valve (4) to close. A device for pumping liquids comprising at least one operating tank (2) of a positive pressure displacement pump (1), to which leads a control gas conduit (10) with a control valve (11) mounted thereon, which is used to close off the inflow valve (4), and the lower section of the operating tank (2) has a narrow section in the form of a vertical cylinder (16).

20 Claims, 3 Drawing Sheets

(56) References Cited

U.S. PATENT DOCUMENTS 3,749,522 A * 7/1973 Kazama et al. ..... 417/54
3,930,755 A 1/1976 Lahr
4,773,830 A * 9/1988 Vetter ..... 417/38
5,749,711 A * 5/1998 Park ..... 417/120
6,200,104 B1 * 3/2001 Park ..... 417/118

* cited by examiner

METHOD AND DEVICE FOR PUMPING LIQUIDS USING A PNEUMATIC POSITIVE DISPLACEMENT PUMP

This application is a §371 national stage of PCT International Application No. PCT/PL2009/050037, filed Nov. 21, 2009, designating the United States and claiming priority of Polish Patent Application PL 386571, filed Nov. 21, 2008, the contents of all of which are hereby incorporated by reference into this application.

The subject of the present invention is a method and device for pumping liquids using a pneumatic positive displacement pump, particularly for pumping sewage containing faecal matter. It may also be used in other pump installations or in the modernization of existing sewage pumping stations tank.

BACKGROUND

There are known methods of pumping liquids, particularly sewage, using at least one positive displacement pump operating tank, which take place in a sequence of two phases: in the filling phase, during which the liquid is admitted into the operating tank through a through and pneumatically controlled inlet valve in place of the gas removed from the tank until it is full; the pumping phase, during which the pneumatically controlled inlet valve located on the inlet of the operating tank is closed and then the compressed working gas is admitted into the tank, under whose pressure the liquid is displaced from the tank, until the tank is emptied.

Two methods of pneumatic inlet valve closing are substantially used.

The first one, commonly used, is the pneumatic control of a blade valve. This form of inlet valve pneumatic control makes it possible to avoid the use of large and uncontrollable hydraulic devices at the outset of the pumping phase, but a blade valve has a limited number of reliable work cycles. For this reason, designs are made for a small number of pumping cycles, and as a result large operating tanks which, in turn, leads a considerable increase of the volume of the operating chambers of such transfer stations, thereby greatly increasing investment costs.

The second commonly used method of controlling the inlet valve closure is closing the inlet valve using the compressed working gas pumped into the operating tank during the pumping stage.

The inlet valves used are, for example, ball float valve with a spherical float, as disclosed in the German patent description DE 100 20 359. These valves, however, can cause large uncontrolled hydraulic pressure waves and are not fully resistant to blocking with contaminants found in faecal sewage. In turn, clapper-type valves (particularly horizontal ones), though more resistant to blocking by contaminants found in faecal sewage, also generate large and uncontrolled hydraulic pressure waves. The noise caused by these spikes often eliminates the use of such transfer stations near residential areas. A structure, which limits the space requirements in a dry pumping station is presented in French patent description FR 2822484. This structure makes it possible to place a pneumatic positive pressure pump in a relatively narrow, prefab dry tank with a round cross-section. A solution is also known from Polish patent application P-382032 (WO 2007/108711 A1), which facilitates an even greater compaction of the pneumatic positive displacement pump in a narrow prefab dry tank with a round cross-section, due to the use of an external retention tank located outside of the dry tank, which has a volume in excess of the operating tank of the pneumatic positive displacement pump. For this reason, the operating tank may be several times smaller than a classic operating tank, and by the same token require a much smaller bottom surface area requirement in the dry tank for the installation of the pneumatic positive displacement pump. High reliability was achieved using elbow ball valves with a non-floating ball (as demonstrated in the European patent application EP 1860245), with an increased number of work cycles of the operating tank. The drawbacks of the abovementioned solutions described as the second method of closing the inlet return valves, are large and uncontrolled hydraulic pressure waves at the beginning of the pumping phase as a result of the introduction of compressed working air into the operating tank of the pneumatic positive displacement pump. These are very distinct when the working pressure exceeds 2 Bar.

Classic pneumatic positive displacement pump operating tank structures have large surface requirements at the bottom of the dry tank they are installed in, or require it to be greatly deepened which makes them vastly more costly to install.

Two basic operating tank structures are known.

The first consists of bottom-fed sewage inflow and outflow into and from the operating tank, which is used most frequently and disclosed in patent descriptions U.S. Pat. Nos. 1,594,483, 3,049,489, in the French patent FR 2822484 as well as in the Polish patent application P-382032 (WO 2007/108711 A1). The abovementioned structures are most preferable in terms of the minimal operating tank depth, which was described in American patent description U.S. Pat. No. 3,302,575 and in the German patent application DE 100 20 359. Such a construct is preferable in light of minimising the surface requirements of the operating, as described in the book entitled "Komunale Abwasserpumpwerke"; by Dieter Weismann—Polish translation, Warsaw, 2001, "Komunalne przepompownie ścieków", edition Seidel-Przywecki Sp. z o. o.

Thus, a need arose for such a novel inflow valve closure control that would ensure the longevity of the control elements, simplicity of use and which would not cause problems with large and uncontrolled hydraulic pressure waves on the inflow valve.

A need has also arisen for the design of a new shape of the operating tank of the pneumatic positive displacement pump, which would minimise the surface area required by the pneumatic positive displacement pump on the bottom of the dry tank, and at the same time would not necessitate increasing the depth of the dry tank.

For the even more optimal use of the bottom of the dry tank, in order to install a device according to the present invention therein, use was made of the advantages of the solution described in Polish patent application P-382032 (WO 2007/108711 A1). This solution consists of the use of the increased capacity of an external pipe operating tank in relation to traditional solutions, and at the same time increasing the number of work cycles of the operating tank. The compressor, being the source of compressed air, powers on and off only after multiple operating cycles of the operating tank, until it empties the external operating tank of the pneumatic positive displacement pump, which lowers the number of power-on cycles of the compressor, and lowers energy usage.

DETAILED DESCRIPTION

Figure 1:
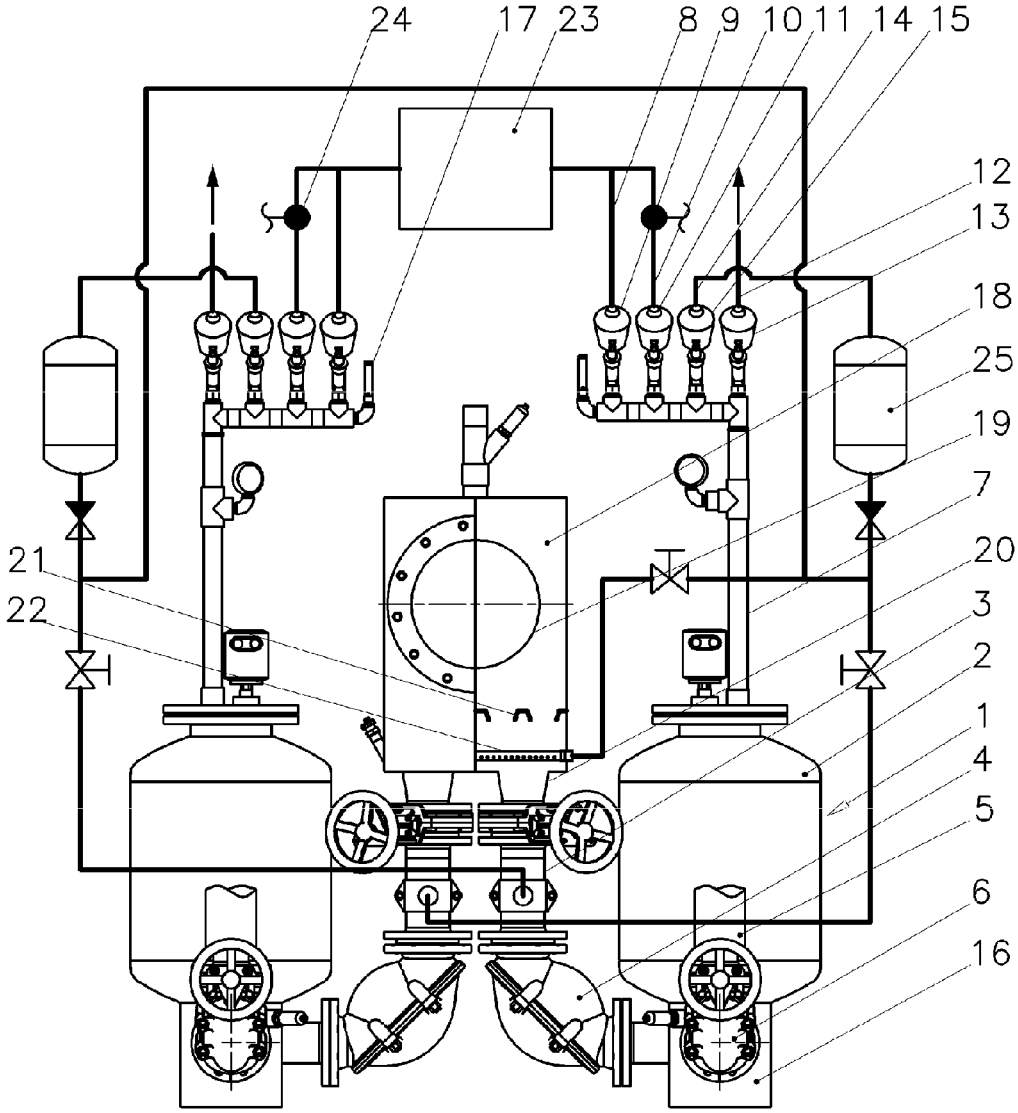
FIG. 1 represents a schematic of the device according to the present invention with two operating tanks in lateral view.

The method according to the present invention is based on the fact that during the pumping stage, the inflow valve closure is actuated by the inflow of the actuating gas into the operating tank of the positive displacement pressure pump with an air pressure lesser than the hydrostatic pressure at the egress from the inflow valve, which causes the inflow valve to close.

During the pumping stage, after the closure of the inflow valve, the flow of the actuating gas to the operating tank is shut off.

Preferentially, during the pumping stage, the flow of compressed working gas is shut off following the displacement of a portion of the liquid from the operating tank, until the operating tank is emptied of the liquid.

Preferentially, at the end of the pumping phase, after emptying the liquid from the operating tank, a portion of the compressed gas found in the operating is used to oxygenate the liquid flowing into the operating tank, An actuating gas conduit is attached to the device according to the present invention, to the operating tank at the inflow valve, and the bottom portion of the operating tank possesses a narrow section in the form of a vertical cylinder, to which is attached the liquid inflow pipe with a controlled pneumatic positive displacement pump mounted thereon, resulting in a decreased surface requirement on the bottom the dry tank needed for the installation of the pneumatic positive displacement pump, by dint of the narrowed bottom of the operating tank.

Preferentially, the upper portion of the operating tank is outfitted with a pneumatic control column with a working compressed actuating gas valve and at least one gas outflow valve and a control valve.

Most preferentially, the pneumatic control column is outfitted with a safety release valve.

Preferentially, a device according to the present invention possesses a bleeder-aerator conduit with a bleeder-aerator valve attached thereto, located between the inflow chamber and the operating tank.

Preferentially, the device according to the present invention possesses an inflow chamber with a gravity-fed conduit leading into it, which possesses a confusor with an inflow conduit.

Most preferentially, the inflow chamber possesses a separating baffle, and between the separating baffle and the inflow confusor there is an aeration lattice.

Preferentially, the actuating gas conduit is supplied by a compressed gas source, where between the compressed gas source and the operating tank there is a reducing valve on the actuating gas conduit.

Most preferentially, the bleeder-aerator conduit is fed by a compressed air tank.

Preferentially, the aerating lattice is connected to a compressed air tank through the bleeder-aerator conduit.

An advantage of the method according to the present invention is that due to the introduction of an actuating gas into the operating tank with regulated pressure, which is smaller than the working pressure, gentle inflow valve closure was achieved, without the generation of hydraulic pressure waves. An additional advantage of the method according to the present invention is also the fact that due to the compressed actuating gas flow being shut off, already prior to the end of the pumping phase (operating tank partially empty), the energy of the compressed gas contained in the operating tank is used to further displace the liquid from the operating tank. As a result of this, a gradual decrease in flow rate us achieved in the outflow. This results in a greatly reduced hydraulic pressure wave on the outflow conduit and the outflow return valve. An additional effect is a decrease in energy usage due to the decreased volume of air used per pumping cycle, which is supplied by a compressed gas source such as a compressor. An advantage of the method according to the present invention is also the possibility of using a portion of the compressed actuating gas (air) supplied during the pumping cycle to displace the sewage from the operating tank for aerating the sewage.

An advantage of the device according to the present invention is the maximum compaction of the pneumatic positive displacement pump and a decrease of the surface area the bottom of the dry tank, which is occupied by the installation of the pneumatic positive displacement pump, due to the narrowed bottom of the operating tank. An additional advantage of a device according to the present invention is that the use of a pneumatic control column with its mounted valves makes the device much more compact, while ensuring comfortable servicing.

Figure 2:
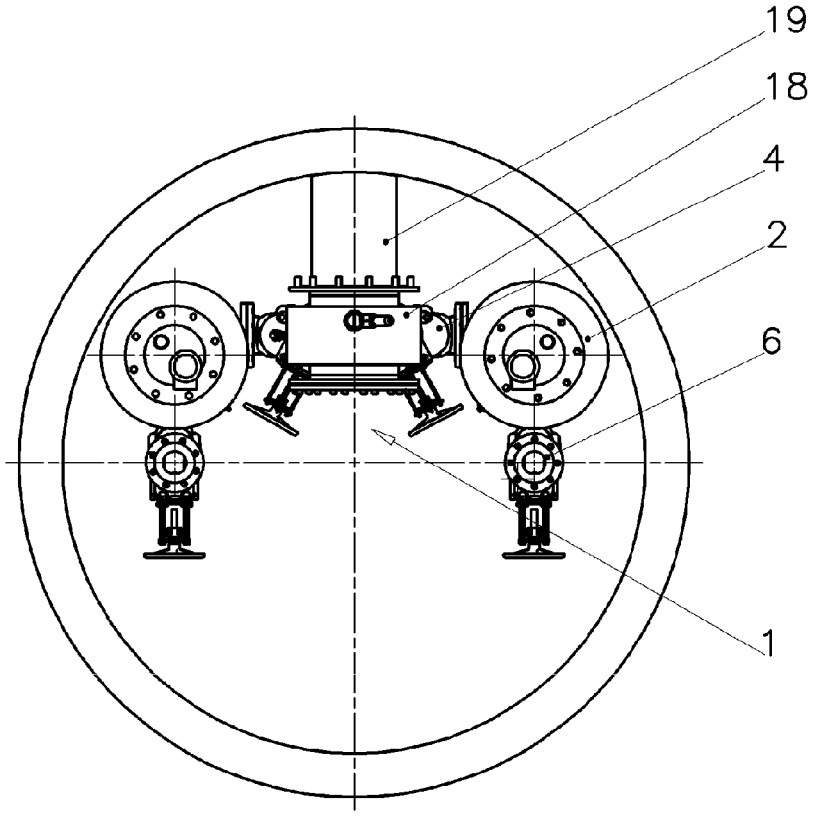
FIG. 2 represents a top view of a device according to the present invention from FIG. 1.
Figure 4:
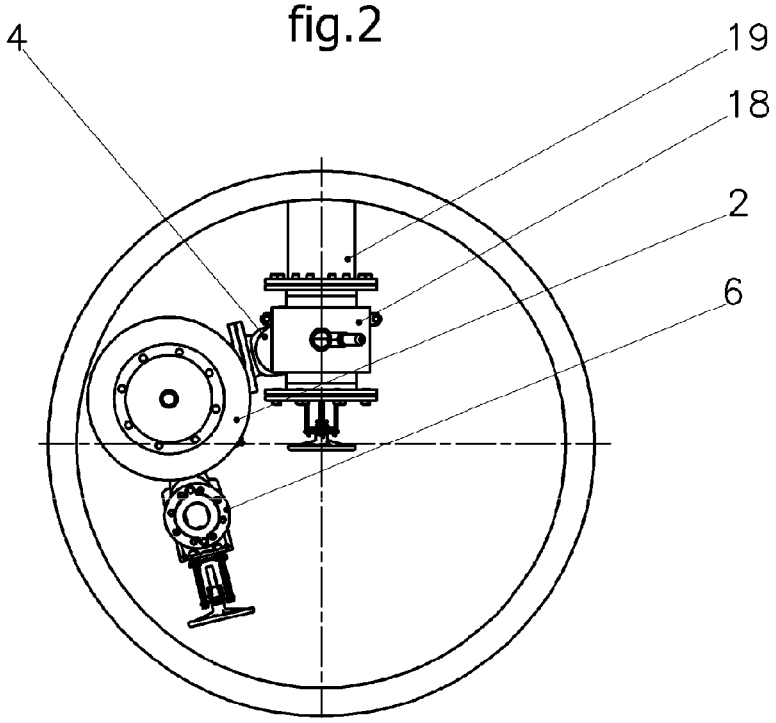
FIG. 4 represents a top view of a device according to FIG. 3.
Figure 3:
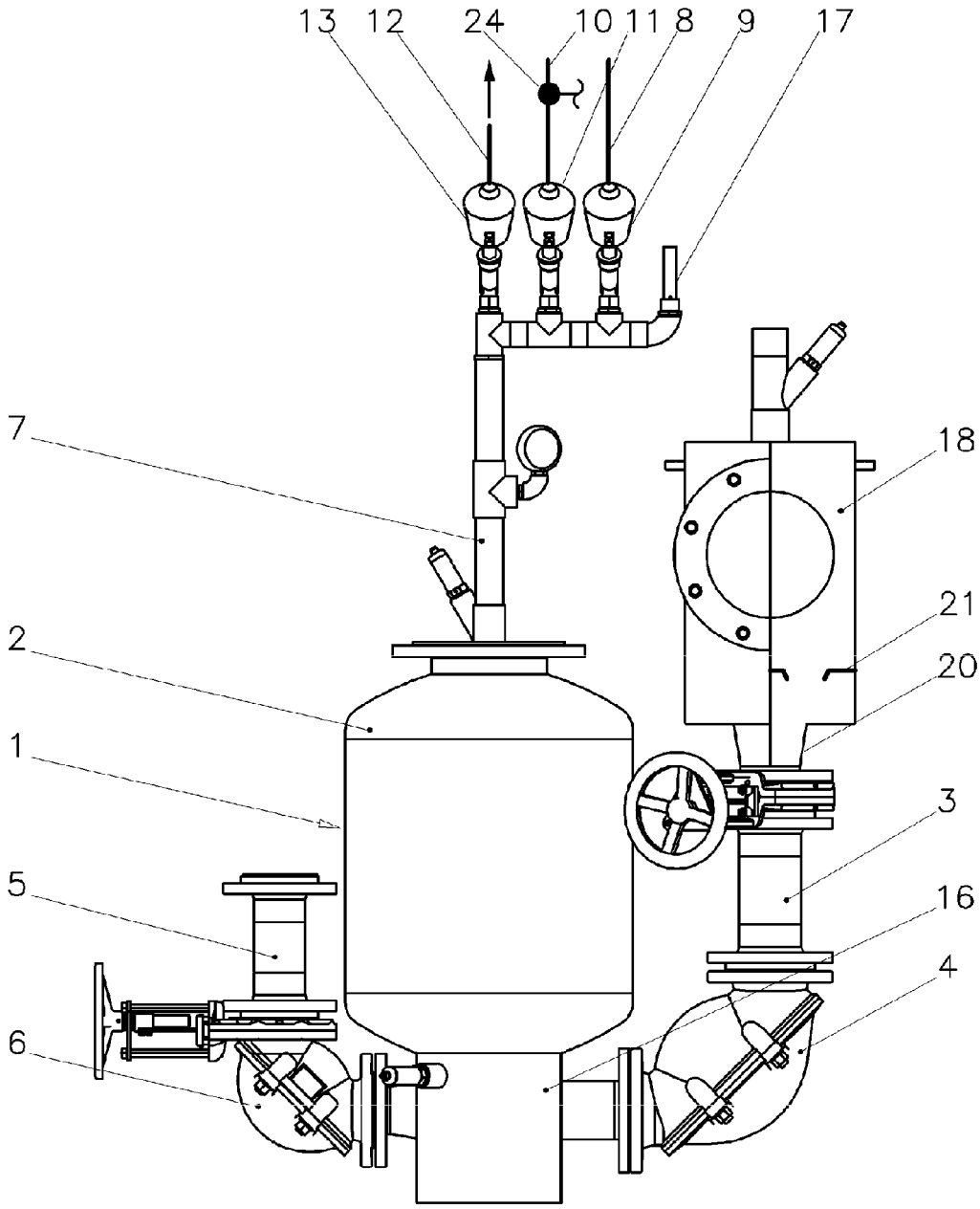
FIG. 3 represents a schematic of a device with a single operating tank in lateral view and a half-section of the inflow chamber.

The subject of the present invention is better illustrated in the example embodiments in which FIG. 1 represents a schematic of the device according to the present invention with two operating tanks in lateral view, FIG. 2 represents a top view of a device according to the present invention from FIG. 1, and FIG. 3 represents a schematic of a device with a single operating tank in lateral view and a half-section of the inflow chamber, whereas FIG. 4 represents a top view of a device according to FIG. 3.

A device according to the present invention, as shown in FIG. 1, positive pressure displacement pump 1 equipped with at least one operating tank 2. The operating tank 2 is supplied by inflow conduit 3 with a pneumatically controlled inflow valve 4 mounted thereon and an outflow conduit 5 leads out, with a return outflow valve 6 mounted on it. Furthermore, the upper portion of the operating tank 2, through a shared pneumatic control column 7, is connected to an actuating gas conduit 8 with a working valve 9 mounted thereon and a control gas conduit 10 with a control valve 11 mounted thereon. From the upper portion of the operating tank 2, through a shared pneumatic control column 7, there leads a bleeder gas conduit 12 with a bleeder valve 13 mounted thereon as well as a bleeder-aerator conduit 14 with a bleeder-aerator valve 15 mounted thereon, which conduit is led into the inflow conduit 3, between the inflow chamber 18, and the operating tank 2.

The operating tank 2 possesses, in its bottom part, a narrowed section in the form of a vertical cylinder 16, to which is attached the liquid inflow conduit 3 with a pneumatically controlled inflow valve 4 mounted thereon as well as a liquid outflow conduit 5, with an outflow return valve mounted thereon. The pneumatic control column 7 is equipped with a safety valve 17. The device possesses an inflow chamber 18 with a gravity-fed conduit 19 leading to it, which leads to a confusor 20 with the attached inflow conduit 3. The inflow chamber 18 contains a separating baffle 21. Between the separating baffle 21 and the confusor 20 of the inflow conduit 3, there is an aeration lattice 22 connected to the bleeder-aerator conduit 14. The control gas conduit 10 is supplied by a source of compressed gas 23. Between the source of compressed gas 23 and the operating tank 2, on the control gas conduit there is a reduction valve 24. The bleeder-aerator conduit 14 is connected to an accumulating gas tank 25, which supplies air to the aeration lattice 22 and the inflow conduit 3.

FIG. 2 represents a top view of an example layout of a pneumatic positive pressure displacement pump 1 with two operating tanks 2 in a dry tank, in the form of a tank with a round cross-section.

FIG. 3 represents a schematic of a device according to the present invention with a single operating tank in lateral view, where in contrast to the device in FIG. 1 it possesses a single operating tank 2 and no aeration function of the sewage inflowing into the operating tank 2.

FIG. 4 represents, top view, an example layout of a pneumatic positive pressure displacement pump 1 with a single operating tank 2 in the dry tank, in the form of a tank with a round cross-section.

The functioning of the device according to the present invention consists of the following. During the filling stage, the sewage flows through the gravity conduit 19 into the inflow chamber 18, where they are transferred over the separating baffle 21 and confusor 20, and through the inflow conduit 3 and inflow valve 4 reach the operating tank 2 of the pneumatic positive pressure displacement pump 1. During the filling of the operating tank 2 with sewage, the inflow valve 4 remains open, whereas the return outflow valve 6 in the outflow conduit 5 remains closed. At the same time, the bleeder valve 13 of the bleeder gas conduit 12 opens so that the air in the operating tank 2 can escape. The air supply through the actuating gas conduit 8 from the source of compressed gas 23, which may be a compressor or a compressed air tank, is closed off with the working valve 9. After the operating tank 2 is filled, a level sensor sends a signal initiating the pumping process.

During the pumping phase, the inflow valve 4 located on the inflow conduit 3 is closed by the control gas supplied via the control gas conduit 10 the operating tank 2, following the opening of the control valve 11. The bleeder valve 13 closes off the outflow of air from the operating tank 2, and the working valve 9 opens. In effect, the sewage is pushed out by compressed air from the operating tank 2 and forced into the outflow conduit 5. Sewage pumping will continue until a preset time expires or an appropriate level is reached in the operating tank 2. Next, the compressed air in the tank is decompressed in the noise muffler, and the system switches to the filling phase.

The gas pressure in the control gas conduit 10, which is usually compressed air, is regulated via the reduction valve 24. In practice, this pressure is lower than 1 bar and is independent of the pressure of the actuating gas, whose pressure usually varies from 2 to 6 bar. The pneumatic positive pressure displacement pump 1 is protected against undesirable actuating gas surges by the safety valve 17 installed in the pneumatic control column 7.

Due to the use of an additional bleeder-aerator valve 15, installed on the bleeder-aerator conduit 14, which is equipped with an accumulating gas tank 25, it is possible to use a portion of the air being decompressed following a pumping cycle to aerate the sewage. The compressed air amassed in the accumulating gas tank 25 is dosed into the inflow conduit 3 or the aerating lattice 22 installed in the inflow chamber 18, thereby aerating the sewage.

To ensure maximum compaction of the elements of the pneumatic sewage positive displacement pump 1 and to decrease the surface area required on the bottom of the dry tank to install a device according to the present invention therein, the authors foresee a narrowed bottom section of the operating tank 2 in the form of a vertical cylinder 16.

The separating baffle 21, installed in the inflow chamber 18 serves to evenly distribute the streams of liquid flowing into the inflow conduit 3 and, at the same time, protects the positive pressure displacement pump 1 against obstruction with solid particles larger than the cross-section of the outflow conduit 5.

The above example embodiments do not exhaust the scope of all possible embodiments of the manufacture and methods of the solution according to the present invention, protected by claims 1 to 14.

The invention claimed is:

1. A method of pumping a liquid with the aid of at least one operating tank (2) of a pneumatic positive pressure displacement pump (1), which occurs in a sequence of two phases: a filling phase, during which a liquid is admitted into the operating tank through a pneumatically controlled inflow valve (4) located on an inflow conduit (3) to displace gas from the operating tank until the operating tank is filled with the liquid; and a pumping phase during which the pneumatically controlled inflow valve located on the inflow conduit is closed, and then a compressed actuating gas is introduced into the operating tank, which causes an outflow return valve (6) located on an outflow conduit (5) connected to the operating tank to open and the liquid is displaced from the operating tank until the operating tank is empty of the liquid, wherein during the pumping phase the pneumatically controlled inflow valve (4) closure is controlled by the introduction of a control gas into the operating tank (2) of the pneumatic positive displacement pump (1) at a pressure lower than the pressure of the compressed actuating gas and lower than the hydrostatic pressure at the egress from the outflow return valve (6) located on the outflow conduit (5) but at a pressure higher than the hydrostatic pressure at the ingress into the pneumatically controlled inflow valve (4) located on the inflow conduit (3), which causes the pneumatically controlled inflow valve (4) to close.

2. The method according to claim 1, wherein during the pumping phase, following the closure of the pneumatically controlled inflow valve (4), supply of control gas to the operating tank (2) is shut off.

3. The method according to claim 1, wherein during the pumping phase, after a portion of the liquid is displaced from the operating tank (2), supply of the compressed actuating gas is shut off, until the operating tank (2) is emptied of liquid.

4. The method according to claim 1, wherein towards the end of the pumping phase, following the emptying of the operating tank (2) of liquid, a portion of the compressed gas found in the operating tank (2), is used to aerate sewage inflowing into the operating tank (2).

5. The method according to claim 1, wherein the liquid is sewage.

6. The method according to claim 3, wherein towards the end of the pumping phase, following the emptying of the operating tank (2) of liquid, a portion of the compressed gas found in the operating tank (2), is used to aerate the liquid inflowing into the operating tank (2).

7. The method according to claim 6, wherein the liquid is sewage.

8. A device for pumping a liquid comprising at least one operating tank (2), which comprises an inflow conduit (3) with a pneumatically controlled inflow valve (4) mounted thereon and an outflow conduit (5) with an outflow valve (6) mounted thereon, as well as an actuating gas conduit (8) with a working valve (9) mounted thereon and a bleeder gas conduit (12) with a bleeder gas valve (13) mounted thereon, from the operating tank, wherein a control gas conduit (10) leads to the operating tank (2) with a control valve (11) mounted thereon, which closes off the pneumatically controlled inflow valve (4) and a bottom part of the operating tank (2) has a narrow section in the form of a vertical cylinder (16), to which is connected the inflow conduit (3) with the pneumatically controlled inflow valve (4) mounted thereon and the liquid outflow conduit (5) with the outflow valve (6) mounted thereon.

9. The device according to claim 8, wherein at an upper portion of the operating tank (2) there is attached a pneumatic control column (7) with a working valve (9) mounted on the pneumatic control column for the compressed actuating gas and with at least one of the gas bleeder valve (13) and the control valve (11) additionally mounted on the pneumatic control column.

10. The device according to claim 9, wherein the pneumatic control column (7) has an attached safety valve (17).

11. The device according to claim 8, further comprising a bleeder-aerator conduit (14) with a bleeder-aerator valve (15) mounted thereon, which is led into the inflow conduit (3).

12. The device according to claim 8, further comprising an inflow chamber (18) with a gravity fed conduit (19) leading to the inflow chamber, and the inflow chamber leads to a confusor (20) which is connected to the inflow conduit (3).

13. The device according to claim 12, wherein in the inflow chamber (18) there is a separating baffle (21).

14. The device according to claim 13, wherein between the separating baffle (21), and the confusor (20) there is an aeration lattice (22).

15. The device according to claim 8, wherein the control gas conduit (10) is supplied by a compressed gas source (23), where between the compressed gas source (23) and the operating tank (2), on the control gas conduit (10) there is a reduction valve (24).

16. The device according to claim 11, wherein an air accumulating gas tank (25) is connected to the bleeder-aerator conduit (14).

17. The device according to claim 14, wherein the aerating lattice (22), is attached to an air accumulating gas tank (25) through the bleeder-aerator conduit (14).

18. The device according to claim 8, wherein the liquid is sewage.

19. The device according to claim 16, wherein the liquid is sewage.

20. The device according to claim 17, wherein the liquid is sewage.

* * * * *

UNITED STATES PATENT AND TRADEMARK OFFICE

CERTIFICATE OF CORRECTION

PATENT NO. : 8,641,386 B2
APPLICATION NO. : 13/130400
DATED : February 4, 2014
INVENTOR(S) : Szuster et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 337 days.

Signed and Sealed this
Twenty-second Day of September, 2015

Michelle K. Lee

Michelle K. Lee
*Director of the United States Patent and Trademark Office*